United States Patent [19]

Hilburger

[11] Patent Number: 4,987,869

[45] Date of Patent: Jan. 29, 1991

[54] DEVICE FOR CONTROLLING A VEHICLE ENGINE-BRAKING SYSTEM

[75] Inventor: Walter Hilburger, Nürtingen, Fed. Rep. of Germany

[73] Assignee: Daimler-Benz AG, Fed. Rep. of Germany

[21] Appl. No.: 517,723

[22] Filed: May 2, 1990

[30] Foreign Application Priority Data

May 4, 1989 [DE] Fed. Rep. of Germany ..... 3914698

[51] Int. Cl.[5] ..... F02D 9/06

[52] U.S. Cl. ..... 123/323; 188/273

[58] Field of Search ..... 123/323, 397, 198 D, 123/327, 585; 188/273

[56] References Cited

U.S. PATENT DOCUMENTS

| | | | |
|---|---|---|---|
| 3,199,498 | 8/1965 | Scholtyssak | 123/323 |
| 3,591,959 | 7/1971 | Kubis | 123/323 |
| 3,838,670 | 10/1974 | King | 123/323 |
| 4,106,584 | 8/1978 | Matsubara | 123/323 |
| 4,149,618 | 4/1979 | Horic | 123/323 |
| 4,267,807 | 5/1981 | Ashfield | 123/323 |
| 4,335,849 | 6/1982 | van Bashvysen | 123/323 |
| 4,354,464 | 10/1982 | Fujita | 123/323 |
| 4,393,831 | 7/1983 | Bergmann et al. | 123/323 |
| 4,473,047 | 9/1984 | Jakuba et al. | 123/323 |

FOREIGN PATENT DOCUMENTS

| | | | |
|---|---|---|---|
| 3339053 | 10/1983 | Fed. Rep. of Germany | 123/323 |
| 3428626 | 8/1984 | Fed. Rep. of Germany | 123/323 |

OTHER PUBLICATIONS

Magazine Article from ATZ Automobiltechnische Zeitschrift 90 (1988), Authors: Wolf-Dietrich Korner, Horst Bergmann und Eckhard Weiss; Title: Die Motorbremse von Nutzfahrzeugen-Gronzon und Moglichkeiten zur Weiterentwicklung.

*Primary Examiner*—Raymond A. Nelli

*Attorney, Agent, or Firm*—Evenson, Wands, Edwards, Lenahan & McKeown

[57] ABSTRACT

A process and apparatus for controlling an engine-braking system of an internal-combustion engine driving a vehicle is provided with brake flaps arranged in the exhaust-gas lines and constant-throttle valves provided in the cylinder heads. In the event of an activation of the engine-breaking system, the brake flaps are transferred to their closing position and the constant-throttle valves to their opening position. To exclude the possibility that the internal-combustion engine will stop as a result of a sudden decrease in speed during the engine-braking mode, it is proposed to put the brake flaps in their opening position and the constant-throttle valves in their closing position when the speed of the internal-combustion engine falls below a predetermined threshold value.

8 Claims, 1 Drawing Sheet

DEVICE FOR CONTROLLING A VEHICLE ENGINE-BRAKING SYSTEM

BACKGROUND AND SUMMARY OF THE INVENTION

The invention relates to a process and apparatus for controlling an engine-braking system of an internal combustion engine driving a vehicle that is provided with brake flaps arranged in the exhaust-gas lines and constant-throttle valves provided in the cylinder heads. In the event of an activation of the engine-braking system, the brake flaps are transferred to their closing position and the constant-throttle valves to their opening position.

In a device of the relevant generic type known from German Patent Specification No. 3,428,626, the brake pedal of the vehicle is connected to a control cylinder which is designed in such a way that, with an increasing actuation of the brake pedal, successively first the constant-throttle valves are opened and only thereafter is the brake flap arranged in the exhaust-gas line closed. So that the maximum engine-braking capacity can be achieved, the brake pedal therefore has to be actuated sufficiently far.

An object on which the invention is based is to provide a device of the type referred to above in which actuation of the engine-braking system is simplified and the possibility of activating the engine-braking system below a predetermined limit value for the speed of the internal-combustion engine is excluded.

This object is achieved by providing an arrangement wherein an accumulator connected to a fluidic line system having first and second branches, the at least one brake flap being actuable by fluid pressure in the first line branch and the constant pressure valves being actuable by fluid pressure in the second line branch, wherein, above a predetermined engine speed threshold valve, the first valve arrangement is in its first switch position when a switch unit is actuated for activating the engine-braking system and when the pressure in the line portion between the second valve arrangement and the constant-throttle valves is simultaneously above a predetermined first limit pressure, wherein the second valve arrangement is in its first switch position either when, above the predetermined engine speed threshold value, the switch unit is actuated for activating the engine-braking system or when, after the release of the switch unit, the pressure in the line portion between the first valve arrangement and the actuator for actuating the brake flap is above a second limit pressure, the second limit pressure being lower than the first limit pressure, and wherein the two valve arrangements are in their second switch position when the speed of the internal-combustion engine is below the predetermined threshold value.

The device according to the invention provides an engine-braking system which can be activated or deactivated completely in a simple way by the vehicle driver. At the same time, there is always the guarantee that, during activation, first the constant-throttle valves are opened and only thereafter are the brake flaps in the exhaust-gas line closed, or, in the opposite instance, during deactivation first the brake flaps are opened and only thereafter are the constant-throttle valves closed again. An operating state in which the internal-combustion engine works normally, but the brake flap is still closed, consequently cannot arise. There is therefore no possibility of damage to the internal-combustion engine as a result of too high a pressure level in the exhaust-gas line because of simultaneously closed brake flap and constant-throttle valves. This applies especially to the use of reduced-gap brake flaps, that is to say brake flaps which, when in their closing position, still leave free only an extremely small exhaust-gas line cross-section. At the same time, with the device according to the invention, the possibility that the internal-combustion engine will stop as a result of a sudden decrease in speed is excluded.

Other objects, advantages and novel features of the present invention will become apparent from the following detailed description of the invention when considered in conjunction with the accompanying drawings.

DETAILED DESCRIPTION OF THE DRAWINGS

Figure 1:
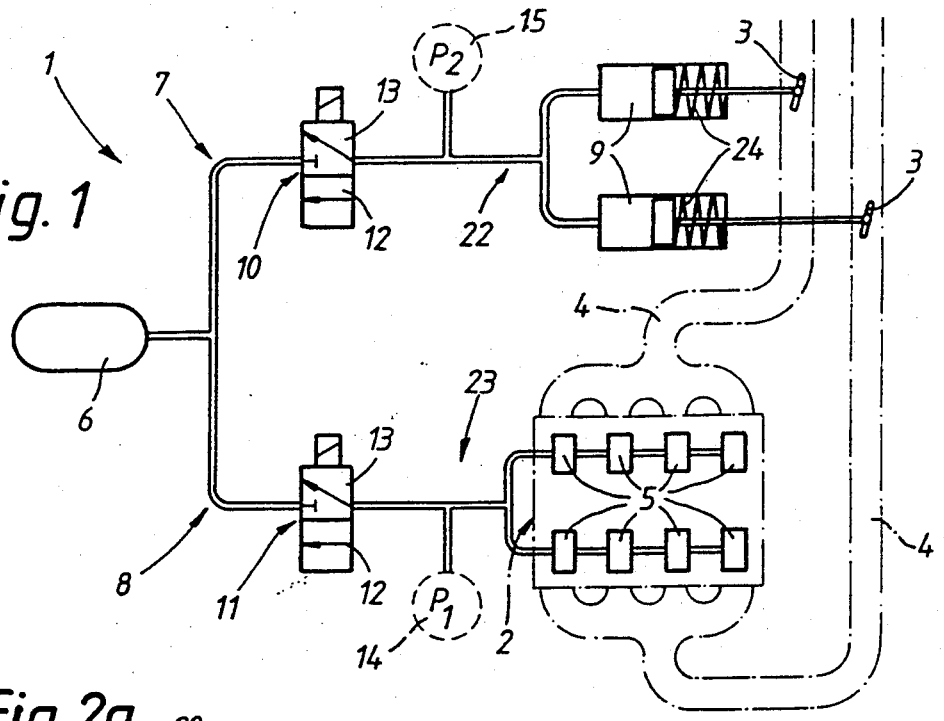
FIG. 1 schematically shows a basic representation of an advantageous device for carrying out the process according to the invention.

FIG. 1 shows a pneumatic line system 1, via which an engine-braking system of an 8-cylinder Diesel internal-combustion engine 2 of the V-type is controlled. The engine-braking system consists of two brake flaps 3, each of which is located in the exhaust-manifold line 4 of a cylinder bank, and of constant-throttle valves 5 intended for each cylinder and inserted respectively in the cylinder head. In the engine-braking mode, the two brake flaps 3 are in the closing position. In this case, closing position does not mean completely closed, but in this position the cross-sections of the two exhaust manifold lines 4 are reduced to a minimum. The constant throttle valves 5 are opened in the engine-braking mode, but in this position expose only a small throttle gap, via which the compressed air can flow out.

The line system 1 is connected to a compressed-air source 6 and branches into two line branches 7 and 8, of which one line branch 7 is connected to the pneumatic cylinders 9 for actuating the brake flaps 3 provided in the exhaust-manifold lines 4 of the internal-combustion engine 2 and the other line branch 8 is connected to the individual constant-throttle valves 5 of the internal-combustion engine 2. One constant-throttle valve 5 is provided for each cylinder. Located in each of the two line branches 7 and 8 is an electromagnetically controllable valve 10, 11 which can assume two switch positions 12 or 13, of which the first position 12 makes communication between the compressed-air source 6 and the brake-flap cylinders 9 (electromagnetic valve 10) or communication between the compressed-air source 6 and the constant-throttle valves 5 (electromagnetic valve 11). In the second switch position 13, the line portion towards the compressed-air source 6 is shut off and the line portion 22 towards the brake-flap cylinders 9 or 23 towards the constant-throttle valves 5 is connected to the environment, that is to say ventilated.

Figure 2A:
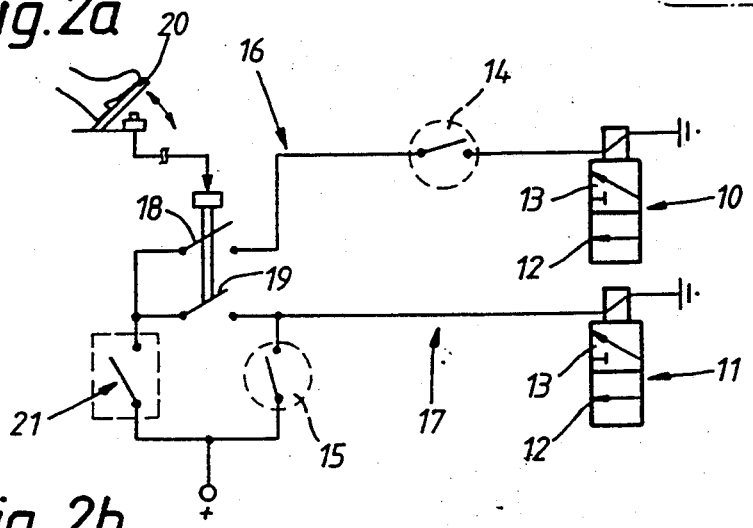
FIG. 2*a* schematically shows an electrical circuit diagram for controlling the electromagnetic valves designated by 10 and 11 in FIG. 1.
Figure 2B:
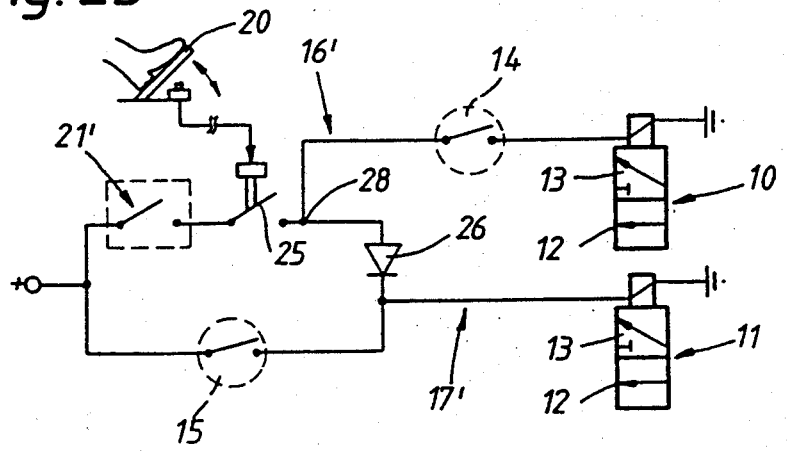
FIG. 2*b* shows a further electrical circuit diagram for controlling the electromagnetic valves designated by 10 and 11 in FIG. 1.

Provided in the line portion 23 between the electromagnetic valve 11 and the constant-throttle valves 5 is a first pressure switch 14 which is part of the electrical circuits described in more detail in FIGS. 2*a* and 2*b* and intended for controlling the two electromagnetic valves 10 and 11 and which is in the opening position as long as the pressure in this line portion has not yet exceeded a first limit pressure of, for example, 7 bar overpressure. Provided in the line portion 22 between the electromagnetic valve 10 and the brake-flap cylinders 9 is a second pressure switch 15 which is likewise part of the electrical circuit described in FIGS. 2*a* and 2*b* and which is in the opening position below a second limit pressure of, for example, 1 bar overpressure.

A possible control of the two electromagnetic valves 10 and 11 is obtained via the electrical circuit shown n FIG. 2*a*. Here, the electromagnetic valve 10 is switchable via a first circuit 16 and the electromagnetic valve 11 via a second circuit 17. In the first circuit 16, the pressure switch 14 and a first engine-braking switch 18 are arranged in series with the electromagnetic valve 10. in the second circuit 17, a second engine-braking switch 19 is provided in series with the electromagnetic valve 11. The two engine-braking switches 18 and 19 are coupled mechanically to one another in the form of a double switch, in such a way that the two switches 18 and 19 are simultaneously either in the opening position or in the closing position. As required (for example, during downhill driving), the two engine-braking switches 18 and 19 are actuated by the driver by the actuating of a pedal 20 provided inside the vehicle, with the pedal depressed the two switches 19 and 20 being in their closing position. The second pressure switch 15 is arranged in parallel with the second engine-braking switch 19. Where both circuits 16 and 17 are concerned, when they are closed the electromagnetic valves 10 and 11 are held in their first switch position 12, otherwise they are held in their second switch position 13. In the first switch position 12, the constant-throttle valves 5 are in their opening position and the brake flaps 3 in the exhaust-manifold lines 4 are in their closing position or in their position reducing the cross-section of the exhaust-gas line to a minimum. In this case, therefore, the engine-braking mode is in operation.

In series with the two engine-braking switches 18 and 19, but in parallel with the second pressure switch 15, is a switch arrangement 21 which is open below a predetermined limit value for the speed of the internal-combustion engine of, for example, 900 revolutions per minute, but is otherwise closed.

When the pedal 20 is not actuated, the two circuits 16 and 17 are interrupted or disconnected by means of the opened engine-braking switches 18 and 19. That is to say the two electromagnetic valves 10 and 11 are in their second switch position 13, in which in each case the line portion towards the compressed-air source 6 is closed and in each case the line portion 22 towards the brake-flap cylinders 9 or 23 towards the constant-throttle valves 5 is connected to the environment. Ambient pressure therefore prevails in the line portions 22 and 23, so that the two pressure switches 14 and 15 are open. Now, when the pedal 20 is actuated by the driver, that is to say the two engine-braking switches 18 and 19 are closed, then the second circuit 17 is closed immediately, of course on the assumption of a speed above the limit speed of the switch arrangement 21, since otherwise the switch arrangement 21 would be open. Consequently, the electromagnetic valve 11 is transferred to its first switch position 12, with the result that the constant-throttle valves 5 are loaded and opened and therefore cause a first engine-braking effect. The first circuit 16 is still initially open as a result of the still open pressure switch 14. If the pressure in the line portion 23 between the electromagnetic valve 11 and the constant-throttle valves 5 exceeds the first limit value of 7 bars overpressure, this leads to a closing of the pressure switch 14 and therefore also to a closing of the first circuit 16. The electromagnetic valve 10 likewise thereby jumps into its first switch position 12, so that the brake-flap cylinders 9 are now also loaded by the compressed-air source, thus leading to a closing of the brake flaps 3 in the exhaust-manifold lines 4 of the internal-combustion engine 2 and consequently to an increase in the braking capacity. Furthermore, the pressure rise in the line portion between the electromagnetic valve 10 and the brake-flap cylinders 9 causes a closing of the pressure switch 15.

If a sudden decrease in speed now occurs during the engine-braking mode, for example because the engine has jumped out of a particular gear, then, as soon as the predetermined limit value of 900 revolutions per minute is reached, the switch arrangement is opened. That is to say the first circuit 16 is broken abruptly, so that the electromagnetic valve 10 also changes immediately to its second switch position 13. This signifies a ventilation of the line portion 22 and therefore an opening of the brake flaps 3 via return springs 24 provided in the brake-flap cylinders 9. When the pressure in the line portion 22 has fallen below 1 bar overpressure, the second pressure switch 15 too is opened, so that the electromagnetic valve 11 also jumps into its second switch position 13. This leads to a closing of the constant-throttle valves 5. The internal-combustion engine 2 is thereby once again in its normal operating mode, thus excluding the possibility that the internal-combustion engine will stop.

Since a certain amount of time elapses between the opening of the switch arrangement 21 and the closing of the constant-throttle valves 5 (the brake flaps 3 are opened first), the limit value for the speed of the internal-combustion engine is selected somewhat higher than the idling speed.

When the two circuits 16 and 17 are closed and the two engine-braking switches 18 and 19 opened, the first circuit 16 is immediately broken and the electromagnetic valve 10 for the brake flaps 3 therefore changes to its second switch position 13, so that the line portion 22 is ventilated and the brake flaps 3 in the exhaust-manifold lines 4 are transferred to their opening position. However, the second circuit 17 is closed again via the second pressure switch 15 only until the pressure in the line portion 22 has fallen below the second limit value of 1 bar overpressure as a result of the ventilation. The opening of the pressure switch 15 then of course causes the electromagnetic valve 11 to jump into its second switch position 13 and consequently causes a closing of the constant-throttle valves 5.

FIG. 2*b* illustrates a further electrical circuit diagram for actuating the two electromagnetic valves 10 and 11. With this solution it is no longer necessary to design the engine-braking switch as a double switch. As in the preceding exemplary embodiment, the engine-braking switch 25, in this case designed as a single switch, is likewise actuable, as required, by the driver via the pedal 20. The engine-braking switch 25 is connected in series with the switch arrangement 21' which likewise breaks the current flow below the predetermined limit speed of 900 revolutions per minute. Supplied from the engine-braking switch 25 is a branching point 28, from which, on the one hand, the electromagnetic valve 10 located in the circuit 16' receives current when the first pressure switch 14 preceding this electromagnetic valve 10 is closed. From the branching point 28, on the other hand, the circuit 17' is supplied via a semiconductor valve 26 polarized in the flow direction and designed as a diode. The electromagnetic valve 11 is located in this circuit 17. Furthermore, this electromagnetic valve 11 can be supplied via the pressure switch 15 which is in parallel with the series connection of the switch arrangement 21', engine-braking switch 25 and diode 26.

The diode 26 therefore ensures that, in the event of a closed engine-braking switch 25 and a closed switch arrangement 21', the two circuits 16' and 17' are supplied, but when the second pressure switch 15 is closed, yet the engine-braking switch 25 or the switch arrangement 21 is open, the supply of current to the first circuit 16' is blocked via the diode 26. When the second pressure switch 15 is closed, a supply of current to the second circuit 17' is always guaranteed.

Under normal driving conditions, that is to say when the pedal 20 is not actuated and therefore the engine-braking switch 25 is open, the first circuit 16' is initially always broken and consequently the first electromagnetic valve 10 is in its second switch position 13. The line portion 22 is therefore ventilated, so that the second pressure switch 15 too is open, that is to say the second circuit 17' is also not supplied. In this state, the constant-throttle valves 5 are closed and the brake flaps 3 open.

Now, when the engine-braking switch 25 is closed via the pedal 20, then, of course on the assumption of a sufficiently high internal-combustion engine speed, since otherwise the switch arrangement 21' would be open, the second circuit 17' is first supplied via the diode 26 and consequently the electromagnetic valve 11 is transferred to its first switch position 12. A pressure rise occurs in the line portion 23 loading the constant-throttle valves 5 and therefore the opening of the constant-throttle valves 5. It is true of both exemplary embodiments that the constant-throttle valves 5 change to their opening position at an overpressure of approximately 6 bars. When an overpressure of 7 bars is reached, the first circuit 16' is also closed, thus leading to the closing of the brake flaps 3 after the first electromagnetic valve 10 has changed over to its first switch position 12.

Should the speed of the internal-combustion engine then suddenly fall below the limit value of 900 revolutions per minute during the braking mode, according to the invention the switch arrangement 21' is opened and the first circuit 16' thereby broken. The ventilation of the line portion 22 leads to the opening of the brake flaps 3. Only when the pressure in the line portion 22 has fallen below 1 bar overpressure does the second pressure switch 15 jump into the opening position, so that only then are the constant-throttle valves 5 closed. Thus, with the second pressure switch 15 still closed, the diode 26 prevents the first circuit 16' from being supplied. This guarantees that the constant-throttle valves 5 are transferred to their closing position only when it is ensured that the brake flaps 3 are already open. Here too, there is a small period of time between the closing of the switch arrangement 21' and the closing of the constant-throttle valves 5 (the brake flaps 3 are opened first). Consequently, here too, the limit value for the internal-combustion engine speed of 900 revolutions per minute is somewhat above the idling speed. An opening of the engine-braking switch 25 during the engine-braking mode has the same effect as the previously described opening of the switch arrangement 21'.

The vehicle battery serves as a voltage source.

In general, of course, the fuel feed is interrupted in the event of opened constant-throttle valves 5.

In a further embodiment of the invention, it is also conceivable, during the engine-braking mode, to match the engine-braking capacity to the driving conditions prevailing at that particular moment. This can be carried out, for example, by a continuous actuation of the brake flaps.

It is likewise possible, if appropriate, for example for only a slight downhill gradient, to open only the constant-throttle valves as an engine brake. This can be obtained by means of a further switch provided in the first circuit 16 or 16' and which remains open, as required.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. Device for controlling an engine-braking system of an internal-combustion engine driving a vehicle comprising:

at least one brake flap arranged in an engine exhaust-gas line, constant-throttle valves provided in engine cylinder heads, said constant-throttle valves being open and the brake flap being closed when the engine-braking system is activated, a pressure accumulator connected to a fluidic line system having first and second line branches, the at least one brake flap being actuable via the first line branch and the constant-throttle valves being actuable via the second line branch, a first valve arrangement with first and second switch positions, disposed in the first line branch, the first switch position causing communication between the pressure accumulator and an actuator actuating the at least one brake flap and the second switch position shutting off the line portion towards the pressure accumulator and venting the actuator to the environment, and a second valve arrangement with two switch positions, disposed in the second line branch, the first switch position causing communication between the pressure accumulator and the constant-throttle valves and the second switch position shutting off the line portion towards the pressure accumulator and venting the constant-throttle valves to the environment, wherein, above a predetermined engine speed threshold value, the first valve arrangement is in its first switch position when a switch unit is actuated for activating the engine-braking system and when the pressure in the line portion between the second valve arrangement and the constant-throttle valves is simultaneously above a predetermined first limit pressure, wherein the second valve arrangement is in its first switch position either when, above the predetermined engine speed threshold value, the switch unit is actuated for activating the engine-braking system or when, after the release of the switch unit, the pressure in the line portion between the first valve arrangement and the actuator for actuating the brake flap is above a second limit pressure, the second limit pressure being lower than the first limit pressure, and wherein the two valve arrangements are in their second switch position when the speed of the internal-combustion engine is below the predetermined threshold value.

2. Device according to claim 1, wherein the first valve arrangement is activatable via a first electrical circuit 16, in which there are connected in series with the first valve arrangement a first pressure switch receiving the pressure in the line portion between the second valve arrangement and the constant-throttle valves and likewise in series a first engine-braking switch actuable as required, wherein the second valve arrangement is activatable via a second electrical circuit, in which a second engine-braking switch actuable as required is connected in series with the second valve arrangement, the two engine-braking switches always assuming the same switch position, wherein a second pressure switch receiving the pressure in the line portion between the first valve arrangement and the actuating device of the at least one brake flap is connected in parallel with the second engine-braking switch, wherein the current flow in the first circuit is controllable via a switch arrangement acting as a function of the engine speed.

3. Device according to claim 2, wherein each of the two valve arrangements is in its first switch position when the respective circuit in which the corresponding valve arrangement is located is closed.

4. Device according to claim 2, wherein the two engine-braking switches are coupled mechanically to one another in the form of a double switch.

5. Device according to claim 3, wherein the two engine-braking switches are coupled mechanically to one another in the form of a double switch.

6. Device according to claim 1, wherein a switch arrangement acting as a function of the engine speed and an engine-braking switch actuable as required are connected in series, wherein a branching point is supplied from the engine-braking switch, wherein a first circuit being supplied from the branching point, in which first circuit the first valve arrangement and the first pressure switch receiving the pressure in the line portion between the second valve arrangement and the constant-throttle valves are connected in series, wherein a second circuit, in which the second valve arrangement is located, is supplied from the branching point via a semiconductor valve polarized in the flow direction, and wherein the second valve arrangement can receive current via the second pressure switch receiving the pressure in the line portion between the first valve arrangement and the actuating device of the brake flap and which is in parallel with the series connection of the switch arrangement, engine-braking switch and semiconductor valve.

7. Device according to claim 6, wherein each of the two valve arrangements is in its first switch position when the respective circuit in which the corresponding valve arrangement is located is closed.

8. Device according to claim 1, wherein the two valve arrangements are actuable electromagnetically.

* * * * *